US008790756B2

(12) United States Patent
Yasumatsu

(10) Patent No.: US 8,790,756 B2
(45) Date of Patent: Jul. 29, 2014

(54) THERMAL-TRANSFER LAMINATE FILM, THERMAL-TRANSFER SHEET, AND IMAGE FORMING APPARATUS

(75) Inventor: Ryo Yasumatsu, Kanagawa (JP)

(73) Assignee: Sony Corporation, Tokyo (JP)

( * ) Notice: Subject to any disclaimer, the term of this patent is extended or adjusted under 35 U.S.C. 154(b) by 76 days.

(21) Appl. No.: 13/404,433

(22) Filed: Feb. 24, 2012

(65) Prior Publication Data

US 2012/0225775 A1 Sep. 6, 2012

(30) Foreign Application Priority Data

Mar. 4, 2011 (JP) ..... 2011-047231

(51) Int. Cl.
*B41M 5/382* (2006.01)
*B41M 7/00* (2006.01)

(52) U.S. Cl.
CPC ..... *B41M 5/38264* (2013.01); *B41M 7/00* (2013.01); *B41M 2205/40* (2013.01)
USPC ..... 428/32.69; 428/32.79; 428/32.81; 503/227

(58) Field of Classification Search
CPC ..... B41M 7/0027–7/0054; B41M 5/38264; B41M 7/0063; B41M 2205/40
USPC ..... 428/32.39–32.87; 503/227
See application file for complete search history.

(56) References Cited

U.S. PATENT DOCUMENTS 7,507,452 B2 * 3/2009 Odamura et al. ..... 428/32.75

FOREIGN PATENT DOCUMENTS

| | | |
|---|---|---|
| JP | 58-147390 | 9/1983 |
| JP | 60-23096 | 2/1985 |
| JP | 60-204397 | 10/1985 |
| JP | 2009-202598 | 9/2009 |
| JP | 2009-292041 | 12/2009 |

* cited by examiner

*Primary Examiner* — Bruce H Hess
(74) *Attorney, Agent, or Firm* — Frommer Lawrence & Haug LLP; William S. Frommer; Joseph W. Treloar

(57) ABSTRACT

A thermal-transfer laminate film includes a base film and an image protection layer. The image protection layer is provided an the base film and contains a thermoplastic resin and a pearl pigment, a content ratio of the pearl pigment with respect to 100 parts by mass of the thermoplastic resin being 0.5 parts by mass or more and 10 parts by mass or less.

16 Claims, 4 Drawing Sheets

THERMAL-TRANSFER LAMINATE FILM, THERMAL-TRANSFER SHEET, AND IMAGE FORMING APPARATUS

BACKGROUND

The present disclosure relates to a thermal-transfer laminate film, a thermal-transfer sheet, and an image forming apparatus including the thermal-transfer laminate film and the thermal-transfer sheet.

From the past, for image protection, a thermal-transfer image protection layer formed of a thermoplastic resin has been laminated on an image formed on a printing paper, that is, an image formed by, for example, a sublimation-type thermal-transfer method that uses a sublimation dye or a thermal diffusion dye.

As a lamination method of a thermal-transfer image protection layer, a method of performing thermocompression bonding on an ink image using a heating roller is known. There is also known a method of structuring an image laminate film including a base film and a thermal-transfer image protection layer that is formed of a thermoplastic resin and formed on the base film and transferring only the heated part of the thermal-transfer image protection layer onto an image using a thermal head or the like, that is, a method that uses a thermal-transfer laminate film (see, for example, Japanese Patent Application Laid-open No. Sho 58-147390, Japanese Patent Application Laid-open No. Sho 60-23096, and Japanese Patent Application Laid-open No. Sho 60-204397).

By laminating the thermal-transfer image protection layer on a formed image as described above, an improvement of an image preservation stability can be expected, for example. In addition, a method of forming a desired surface shape by an image protection layer is proposed. For example, Japanese Patent Application Laid-open No. 2009-292041 proposes an ultra-shiny thermal-transfer laminate film capable of realizing a shinier image than in the related art by enhancing Surface smoothness.

In addition, Japanese Patent Application Laid-open No. 2009-202598 (hereinafter, referred to as Patent Document 5) proposes a method of forming an image that contains a pearlescent pigment and has an iris color and a metallic luster. Specifically, Patent Document 5 proposes a thermal-transfer sheet in which a base sheet is laminated on a back surface layer, a first colorant including a pigment or a dye and a release layer are laminated sequentially on a surface of the base sheet, and a second colorant including a pearlescent pigment is laminated on a surface of the release layer. In Patent Document 5, however, it is necessary to separately provide, in forming a protection layer for protecting a formed image in a method of forming an image using a thermal-transfer sheet and an intermediate thermal-transfer sheet, a second colorant layer including a pearlescent pigment and the protection layer for protecting an image.

SUMMARY

In view of the circumstances as described above, there is a need for a thermal-transfer laminate film and a thermal-transfer sheet that are capable of imparting a pearl glaze to a formed image, and an image forming apparatus including the thermal-transfer laminate film and the thermal-transfer sheet.

According to an embodiment of the present disclosure, there is provided a thermal-transfer laminate film including a base film and an image protection layer.

The image protection layer is provided on the base film and contains a thermoplastic resin and a pearl pigment, a content ratio of the pearl pigment with respect to 100 parts by mass of the thermoplastic resin being 0.5 parts by mass or more and 10 parts by mass or less.

In the thermal-transfer laminate film, in forming an image by a thermal-transfer method, the image protection layer is peeled off from the base film and transferred onto the formed image, with the result that an image preservation property is improved, for example. Further, since the image protection layer contains a pearl pigment, a pearl glaze can be imparted to the image.

The content ratio of the pearl pigment contained in the image protection layer is 0.5 parts by mass or more and 10 parts by mass or less with respect to 100 parts by mass of the thermoplastic resin. As a result, a pearl glaze can be sufficiently imparted to the formed image, and sufficient permeability for maintaining an image quality can be obtained.

A grain size of the pearl pigment is 5 μm or more and 25 μm less. With such a grain size, the image protection layer can be formed without inhibiting productivity.

The image protection layer may additionally contain an ultraviolet absorber. Further, a content ratio of the ultraviolet absorber with respect to 100 parts by mass of the thermoplastic resin in the image protection layer is, for example, 5 parts by mass or more and 50 parts by mass or less.

Since the image protection layer contains an ultraviolet absorber, denaturalization of the pearl pigment due to ultraviolet rays can be suppressed.

The thermal-transfer laminate film may further include an untransferring release layer that is formed of a heat resistant resin and provided between the base film and the image protection layer.

With this structure, the image protection layer can be peeled off from the thermal-transfer laminate film with ease and can also be thermally transferred on the formed image with ease.

The thermal-transfer laminate film may further include an adhesive layer provided on the image protection layer.

With this structure, in peeling off the image protection layer, the image protection layer can be easily bonded to a to-be-recorded medium side.

According to an embodiment of the present disclosure, there is provided a thermal-transfer sheet including a base film, an image protection layer, and an ink layer.

The image protection layer is provided on the base film and contains a thermoplastic resin and a pearl pigment, a content ratio of the pearl pigment with respect to 100 parts by mass of the thermoplastic resin being 0.5 parts by mass or more and 10 parts by mass or less.

The ink layer is provided on the base film.

According to an embodiment of the present disclosure, there is provided an image forming apparatus including a conveyor mechanism, a thermal-transfer sheet, a travel mechanism, and a thermal-transfer head.

The conveyor mechanism is configured to convey a to-be-recorded medium in a predetermined direction.

The thermal-transfer sheet includes an image protection layer and an ink layer. The image protection layer is thermally transferred to protect an image and contains a thermoplastic resin and a pearl pigment, a content ratio of the pearl pigment with respect to 100 parts by mass of the thermoplastic resin being 0.5 parts by mass or more and 10 parts by mass or less. The ink layer forms an image by being thermally transferred onto a surface of the to-be-recorded medium.

The travel mechanism is configured to cause the thermal-transfer sheet to travel.

The thermal-transfer head is configured to cause one of the ink layer and the image protection layer of the thermal-transfer sheet to be thermally transferred onto the surface of the to-be-recorded medium.

According to the embodiments of the present disclosure, it is possible to impart, as well as protect an image formed by a thermal-transfer method, a pearl glaze to the image.

These and other objects, features and advantages of the present disclosure will become more apparent in light Of the following detailed description of best mode embodiments thereof, as illustrated in the accompanying drawings.

DETAILED DESCRIPTION OF EMBODIMENTS

Hereinafter, embodiments of the present disclosure will be described with reference to the drawings.

First Embodiment

Thermal-Transfer Laminate Film

Figure 1:
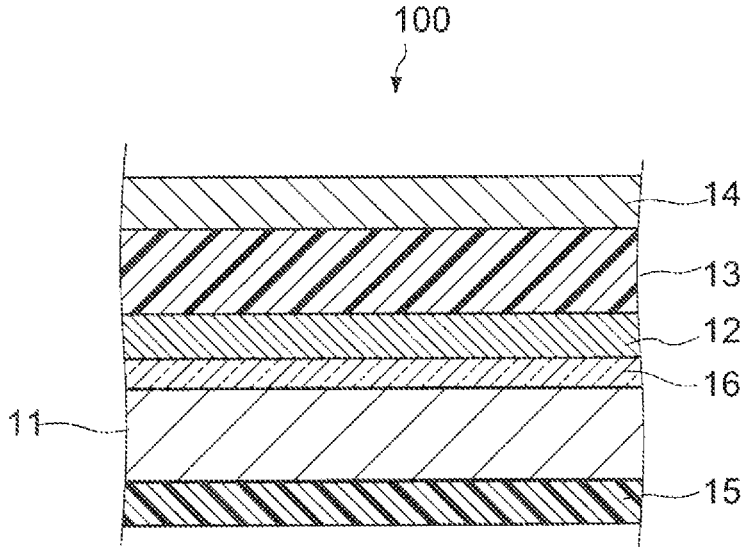
FIG. 1 is a partial cross-sectional diagram showing a structure of a thermal-transfer laminate film according to a first embodiment of the present disclosure.

FIG. 1 is a schematic cross-sectional diagram showing a structural example of a thermal-transfer laminate film according to a first embodiment of the present disclosure.

The thermal-transfer laminate film 100 of this embodiment has a multilayer structure constituted of a base film 11, an untransferring release layer 12, an image protection layer 13, an adhesive layer 14, a heat resistant slipping layer 15, and a primer layer 16.

As shown in FIG. 1, the thermal-transfer laminate film 100 includes the base film 11 and the image protection layer 13, and the image protection layer 13 is formed on the base film 11. The primer layer 16 and the untransferring release layer 12 are interposed between the base film 11 and the image protection layer 13, and the adhesive layer 14 is formed on the image protection layer 13. Further, on a surface of the base film 11 on the other side of the surface on which the layers are formed, the heat resistant slipping layer 15 is formed. It should be noted that the primer layer 16, the untransferring release layer 12, the adhesive layer 14, and the heat resistant slipping layer 15 may be omitted as necessary.

(Base Film)

The base film 11 is constituted of, for example, a transparent plastic film. The base film 11 is not particularly limited and is constituted of a general-purpose plastic film such as a polyester film, a polyethylene film, and a polypropylene film and a super engineering plastic film such as a polyimide film. The materials as described above are capable of holding the laminated layers and have a sufficient resistance with respect to heat applied during thermal transfer. Further, an extension processing method such as a biaxial extension and a longitudinal extension is typically adopted as a method of forming the base film 11, and a thickness is not particularly limited as long as it has sufficient heat resistance, mechanical strength, and the like.

(Primer Layer)

The primer layer 16 is formed on the surface of the base film 11. The primer layer 16 is formed of, for example, an urethane-based resin, an acrylic resin, or a polyester-based resin, though not particularly limited thereto. The material of the primer layer 16 can be selected as appropriate based on the types of resin used for the base film 11 and the untransferring release layer 12. It should be noted that since the primer layer 16 is for enhancing adhesiveness between the base film 11 and the untransferring release layer 12, the primer layer 16 may be omitted when there is sufficient adhesiveness between the base film 11 and the untransferring release layer 12.

Typically, the primer layer 16 is formed with a thickness of several μm before the extension processing of the base film 11. After that, by subjecting the base film 11 to, for example, biaxial extension processing, a primer layer 16 having a uniform thickness can be formed. The thickness of the primer layer 16 is not particularly limited and only needs to be uniform while being 1 μm or less, for example.

(Untransferring Release Layer)

The untransferring release layer 12 is formed on the primer layer 16. The untransferring release layer 12 is formed of a heat resistant resin such as a polyvinyl acetoacetal resin, a polyvinyl butyral resin, a copolymer of those, a polyvinyl alcohol resin, an acrylic resin, a polyester resin, a polyamide resin, a polyamide imide resin, a polyether sulfone resin, a polyether ether ketone resin, a polysulfone resin, and a cellulose derivative. By providing the untransferring release layer 12 formed of the materials as described above, the image protection layer 13 can be easily peeled off from the base film 11.

As a method of forming the untransferring release layer 12, there are various methods such as gravure coating, gravure reverse coating, and roll coating for applying a coating fluid including the resin described above and drying it. Moreover, the thickness of the untransferring release layer 12 is not particularly limited, and with a coating thickness of, for example, about 0.1 to 5 μm, a sufficient heat resistance can be obtained and a function of the untransferring release layer 12 is also not impaired.

(Image Protection Layer)

The image protection layer 13 is formed on the surface of the untransferring release layer 12. The image protection layer 13 includes a thermoplastic resin having translucency and a pearl pigment. The thermoplastic resin is not particularly limited, and polymethyl methacrylate is used, for example.

In forming an image by a thermal-transfer method, the image protection layer 13 is peeled off from the untransferring release layer 12 and transferred onto the formed image, with the result that an image preservation property is improved, for example. In addition, various functions can be imparted to the formed image by the thermoplastic resin included in the image protection layer 13. For example, functions of a gas resistance, light fastness, a resistance to plasticizers, an abrasion resistance, a sebum resistance, an impartation of a writing/stamping property, an impartation of, a matte taste to a surface of a printed object, and the like. Further, a desired surface shape such as a matte surface can be formed by nonuniformly varying an energy during thermal transfer. Since the image protection layer 13 includes a pearl pigment, a pearl glaze can be imparted to an image by an easy and inexpensive method.

The pearl pigment is typically a pigment in which a natural mica is coated with a metal oxide such as a titanium oxide and an iron oxide and exhibits a pearl glaze as light that has entered a boundary between a titanium oxide layer having a high refractive index and a mica having a low refractive index and the peripheral medium thereof regularly induces multiple reflections. In addition, an artificially-synthesized alumina flake coated with a metal oxide, an artificially-synthesized silica flake coated with a metal oxide, a flake-like glass as a substrate coated with a titanium oxide on a surface thereof, or the like is used.

More specifically, as a pearl pigment that can be used in this technique, there are pearl pigments available from Merck & Co., Inc. ("Iriodin100" series, "Iriodin200" series, "Iriodin300" series, "Iriodin500" series, "Biflair" series, "Xirallic" series, etc.). In the "Iriodin100" series, a silver-white pearl glaze is obtained by a difference in coverage and grain size of a titanium oxide, and a shiny metallic glaze can be obtained with a large grain size while a soft silky glaze can be obtained with a small grain size. The "Iriodin200" series is of an iris type that can cause incident light to be partially transmitted and split it into a reflected color and a transmission color by a thickness of a titanium oxide layer. In the "Iriodin300" series, a surface of a natural mica is coated with a titanium oxide and an iron oxide is added thereto so that a pearl glaze and a color can be captured as a monochrome. Further, in the "Iriodin500" series; a surface of a natural mica is directly coated with an iron oxide so as to obtain a strong effect in both coloring power and glaze, and a color thereof is a metallic color. The "Biflair" series is a bismuth-based (bismuth oxychloride) pearl pigment with which strong brightness can be obtained while exhibiting a glaze different from that of a mica-based pearl. The "Xirallic" series is a new effect pigment in which an artificially-synthesized alumina flake is coated with a metal oxide and is capable of imparting a design such as brightness; depth, and a high saturation.

A content ratio of the pearl pigment in the image protection layer 13 is 0.5 parts by mass or more and 10 parts by mass or less with respect to 100 parts by mass of the thermoplastic resin. If the content ratio of the pearl pigment is smaller than 0.5 parts by mass with respect to 100 parts by mass of the thermoplastic resin, a sufficient pearl glaze may not be imparted, and if the content ratio exceeds 10 parts by mass, permeability may be lowered. As long as the content ratio of the pearl pigment is 0.5 parts by mass or more and 10 parts by mass or less with respect to 100 parts by mass of the thermoplastic resin, a pearl glaze can be sufficiently imparted to a formed image, and sufficient permeability for maintaining an image quality can be obtained.

The grain size of the pearl pigment is not particularly limited and is, for example, 5 μm or more and 25 μm or less. The image protection layer 13 is formed by, for example, gravure coating, and a gravure plate cylinder that has 150 to 250 LPI is typically used. At this time, when the grain size of the pearl pigment is 25 μm or less, the image protection layer 13 can be formed with ease, and productivity can be maintained. In addition, when the grain size is 5 μm or more, a pearl glaze that can be sufficiently visually recognized can be imparted to a formed image.

Further, the image protection layer 13 may contain an ultraviolet absorber. When the pearl pigment is formed of a bismuth-based material, for example, the pearl pigment may have an unstable property with respect to ultraviolet rays. For suppressing such unstableness, a salicylic acid derivative, a benzophenone derivative, a benzotriazole derivative, an oxalic anilide derivative, or the like is used as the ultraviolet absorber. Due to the ultraviolet absorber included in the image protection layer 13, a pearl glaze can be more inexpensively and stably exhibited. Moreover, a content ratio of the ultraviolet absorber may be 5 parts by mass or more and 50 parts by mass or less with respect to 100 parts by mass of the thermoplastic resin. With this content ratio, an ultraviolet absorption effect can be sufficiently exhibited, and characteristics of the image protection layer 13 are not influenced.

As a method of forming the image protection layer 13, there are various methods such as gravure reverse coating and roll coating in addition to gravure coating for applying a coating fluid including the resin, the pearl pigment, and the like and drying it. Moreover, the thickness of the image protection layer 13 is not particularly limited and can be arbitrarily set so that a coating thickness falls within the range of 0.1 to 20 μm, for example.

(Adhesive Layer)

The adhesive layer 14 is formed on the surface of the image protection layer 13. The adhesive layer 14 is formed of a thermoplastic resin such as a polyester-based, an acryl-based, a cellulose-based, a vinyl chloride-vinyl acetate copolymer, a urethane-based, and an ethylene-vinyl acetate copolymer and is not particularly limited as long as it can easily bond the image protection layer 13 to a to-be-recorded medium side.

As a method of forming the adhesive layer 14 on the base film 11, there are various methods such as gravure coating, gravure reverse coating, and roll coating for applying a coating fluid including the resin described above and drying it. Moreover, the thickness of the adhesive layer 14 is not particularly limited and can be arbitrarily set so that a coating thickness falls within the range of 0.1 to 10 μm, for example.

(Heat Resistant Slipping Layer)

The heat resistant slipping layer 15 is formed on the back surface of the base film 11. The heat resistant slipping layer 15 is provided for enabling a thermal-transfer head (not shown) and the base film 11 to travel without sticking or fusing with respect to each other. It should be noted that the heat resistant slipping layer 15 does not need to be provided in particular when a heat resistance and slip property of the base film 11 are favorable. The material for forming the heat resistant slipping layer 15 is not particularly limited as long as it has a high heat resistance and can keep a friction coefficient between the thermal-transfer head and the heat resistant slipping layer 15 constant during heating and even when not heated. Examples of the material include acetylcellulose, a polyvinyl acetoacetal resin, and a polyvinyl butyral resin.

In the thermal-transfer laminate film 100 of this embodiment having the structure as described above, the image protection layer 13 contains a pearl pigment. Therefore, by thermally transferring the image protection layer 13 onto an ink image, an image preservation property of the formed image is improved, and a pearl glaze can be imparted to the formed image. In other words, an image having a pearl glaze can be formed easily and inexpensively. Further, the content ratio of the pearl pigment is 0.5 parts by mass or more and 10 parts by mass or less with respect to 100 parts by mass of the thermoplastic resin. With such a content ratio, a pearl glaze can be sufficiently imparted to a formed image, and sufficient permeability for maintaining an image quality can be obtained.

Second Embodiment

Figure 2:
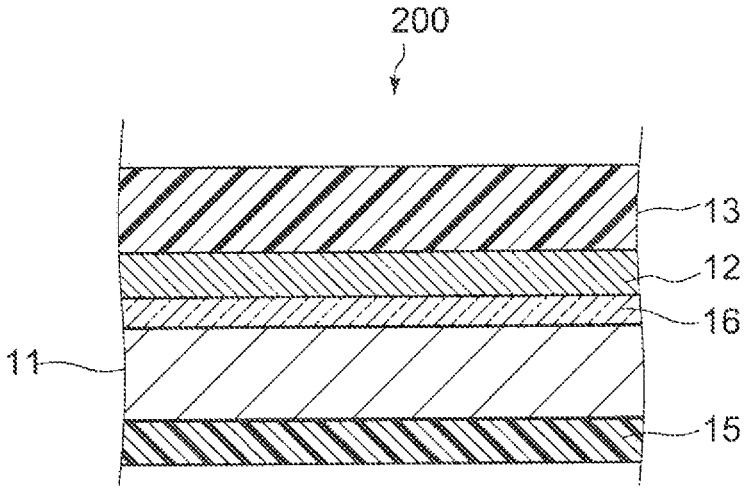
FIG. 2 is a partial cross-sectional diagram showing a structure of a thermal-transfer laminate film according to a second embodiment of the present disclosure.

FIG. 2 is a schematic cross-sectional diagram showing a structural example of a thermal-transfer laminate film according to a second embodiment of the present disclosure. In this embodiment, descriptions on parts having the same structures and operations as those of the first embodiment will be omitted or simplified, and different parts from the first embodiment will mainly be described.

The thermal-transfer laminate film 200 of this embodiment has a multilayer structure constituted of the base film 11, the untransferring release layer 12, the image protection layer 13, the heat resistant slipping layer 15, and the primer layer 16. In a case where the image protection layer 13 can be easily transferred onto a formed image, the adhesive layer 14 does not need to be provided as shown in FIG. 2. As a result, the number of production processes of the thermal-transfer laminate film 200 is reduced, and the thermal-transfer laminate film 200 can be produced inexpensively in a short time.

Third Embodiment

Figure 3:
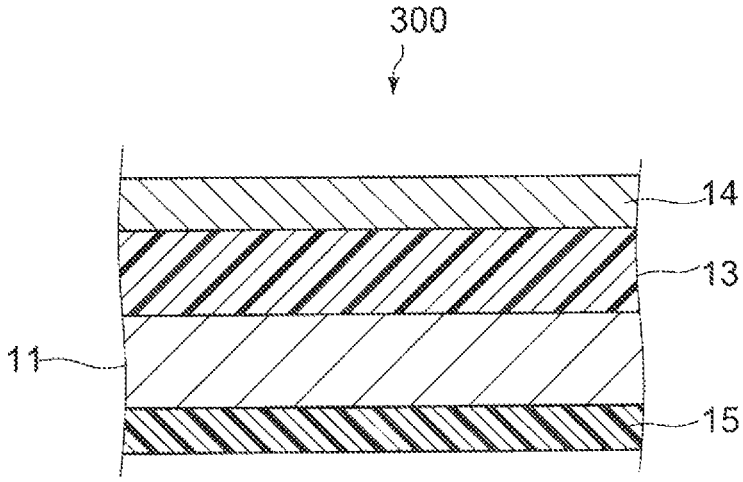
FIG. 3 is a partial cross-sectional diagram showing a structure of a thermal-transfer laminate film according to a third embodiment of the present disclosure.

FIG. 3 is a schematic cross-sectional diagram showing a structural example of a thermal-transfer laminate film according to a third embodiment of the present disclosure. In this embodiment, descriptions on parts having the same structures and operations as those of the first embodiment will be omitted or simplified, and different parts from the first embodiment will mainly be described.

The thermal-transfer laminate film 300 of this embodiment has a multilayer structure constituted of the base film 11, the image protection layer 13, the adhesive layer 14, and the heat resistant slipping layer 15. In a case where the image protection layer 13 can be easily peeled off from the base film 11, the untransferring release layer 12 and the primer layer 16 do not need to be provided as shown in FIG. 3. As a result, the number of production processes of the thermal-transfer laminate film 300 is reduced, and the thermal-transfer laminate film 300 can be produced inexpensively in a short time.

Fourth Embodiment

Figure 4:
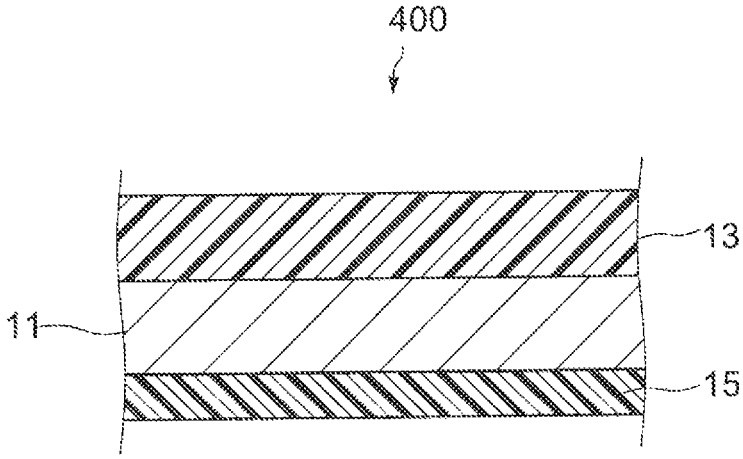
FIG. 4 is a partial cross-sectional diagram showing a structure of a thermal-transfer laminate film according to a fourth embodiment of the present disclosure.

FIG. 4 is a schematic cross-sectional diagram showing a structural example of a thermal-transfer laminate film according to a fourth embodiment of the present disclosure. In this embodiment, descriptions on parts having the same structures and operations as those of the first embodiment will be omitted or simplified, and different parts from the first embodiment will mainly be described.

The thermal-transfer laminate film 400 of this embodiment has a multilayer structure constituted of the base film 11, the image protection layer 13, and the heat resistant slipping layer 15. In a case where the image protection layer 13 can be easily peeled off from the base film 11 and easily transferred onto a formed image, the untransferring release layer 12, the adhesive layer 14, and the primer layer 16 do not need to be provided as shown in FIG. 4. As a result, the number of production processes of the thermal-transfer laminate film 400 is reduced, and the thermal-transfer laminate film 400 can be produced inexpensively in a short time.

Fifth Embodiment

The thermal-transfer laminate films having the structures as described above can be used in a thermal-transfer sheet such as an ink ribbon. Hereinafter, a thermal-transfer sheet having the structure of the thermal-transfer laminate film 100 will be described.

[Thermal-Transfer Sheet]

Figure 5A:
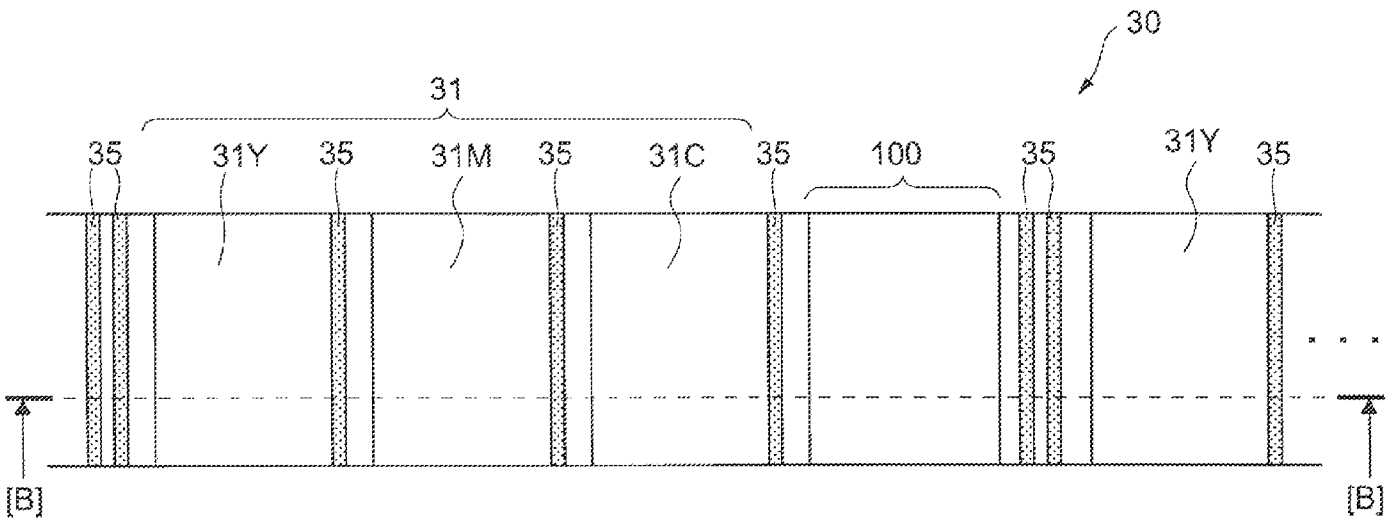
FIG. 5 are diagrams showing a structure of a thermal-transfer sheet according to an embodiment of the present disclosure, FIG. 5A being a plan view and FIG. 5B being a cross-sectional diagram taken along the line <B>-<B> of FIG. 5A.
Figure 5B:
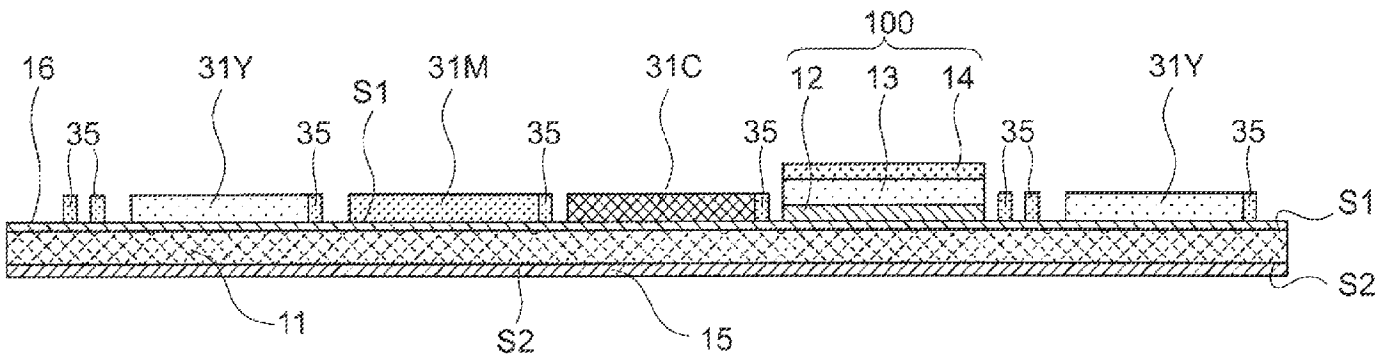

FIG. 5 are schematic diagrams showing the thermal-transfer sheet according to the embodiment of the present disclosure, FIG. 5A being a plan view and FIG. 5B being a cross-sectional diagram taken along the line <B>-<B> of FIG. 5A. The thermal-transfer sheet 30 includes the base film 11, the image protection layer 13 formed on the base film 11, and ink layers 31.

On a first surface S1 side of the base film 11 in the thermal-transfer sheet 30, yellow, (Y), magenta (M), and cyan (C) ink layers 31 (31Y, 31M, 31C) are formed along a conveyance direction of the thermal-transfer sheet 30 via the primer layer 16. Also on the first surface S1 side of the base film 11, the untransferring release layer 12, the image protection layer 13, and the adhesive layer 14 are formed via the primer layer 16. On a back surface (second surface S2) side of the base film 11, the heat resistant slipping layer 15 is formed for lowering a friction between a thermal-transfer head and an ink ribbon and enabling the thermal-transfer sheet 30 to travel stably. It should be noted that the untransferring release layer 12, the image protection layer 13, and the adhesive layer 14 and parts of the base film 11, the primer layer 16, and the heat resistant slipping layer 15 on which the layers above are provided form the thermal-transfer laminate film 100 described above with reference to FIG. 1.

It should be noted that the primer layer 16 does not need to be provided in a case where the base film 11 and the untransferring release layer 12 have sufficient adhesiveness. In addition, the untransferring release layer 12 does not need to be provided in a case where the image protection layer 13 can be easily peeled off from the base film 11, and the adhesive layer 14 does not need to be provided in a case where the image protection layer 13 can be easily transferred onto a formed image. Furthermore, the heat resistant slipping layer 15 does not need to be provided in a case where a heat resistance and slip property of the base film 11 are favorable.

The ink layers 31 (31Y, 31M, 31C) and the thermal-transfer laminate film 100 are formed cyclically in order, and the thermal-transfer laminate film 100 is provided subsequent to the ink layers 31 (31Y, 31M, 31C). Moreover, in the thermal-transfer sheet 30, sensor marks 35 are formed at end portions of the ink layers 31 (31Y, 31M, 31C) and in the vicinity of the thermal-transfer laminate film 100.

The ink layers 31 (31Y, 31M, 31C) are typically formed of a sublimation dye. Further, as a binder resin, a cellulose-based resin such as methyl cellulose, ethyl cellulose, ethyl hydroxyethyl cellulose, hydroxypropyl cellulose, butyric acetate cellulose, and acetate cellulose, a vinyl-based resin such as polyvinyl alcohol, polyvinyl butyral, polyvinyl acetoacetal, polyvinyl acetate, and polystyrene, a polyester-based resin, an acrylic resin, a urethane-based resin, or various other resins may be included.

Pigment dyes of the ink layers 31 (31Y, 31M, 31C) are dispersed or dissolved in the binder resin. The material of the pigment dye is not particularly limited, and specific materials are as follows. Specifically, as a yellow dye, for example, an azoic dye, a disazoic dye, a methine-based dye, a styryl-based dye, a pyridone-azoic dye, or a mixture of those is used. As a magenta dye, for example, an azoic dye, an anthraquinone-based dye, a styryl-based dye, a heterocycle azoic dye, or a mixture of those is used. As a cyan dye, for example, an anthraquinone-based dye, a naphthoquinone-based dye, a heterocycle azoic dye, an indoaniline-based dye, or a mixture of those is used. It should be noted that a mixture of a plurality of types of dyes is often used as the pigment dyes.

Typically, a dye having a thermal transitivity to cause a thermal diffusion from inside the ink layers 31 in a pigment dye molecule unit is used as the pigment dyes. The characteristics required for the pigment dyes are that, for example, a thermal decomposition is not caused within a thermal energy range of the thermal-transfer head, syntheses are simple, an image preservation property is excellent (stable with respect to heat, light, temperature, drug), an absorption wavelength range is favorable, and recrystallization is hard to be caused in the ink layer.

When performing thermal-transfer printing by an image forming apparatus (e.g., thermal-transfer printer) using the thermal-transfer sheet 30, a desired image can be obtained by thermally transferring the image protection layer 13 and adhesive layer 14 part of the thermal-transfer laminate film 100 onto an ink image by a thermal-transfer head of the printer. In other words, after an image is formed by thermally transferring the ink layers 31 of the thermal-transfer sheet 30, peeling occurs at the boundary between the untransferring release layer 12 and the image protection layer 13 in the thermal-transfer laminate film 100 formed in a part of the thermal-transfer sheet 30, and the image protection layer 13 and the adhesive layer 14 formed thereon are thermally transferred onto the ink image.

In the thermal-transfer sheet 30 of this embodiment, the image protection layer 13 contains a pearl pigment. Therefore, by thermally transferring the image protection layer 13 onto an ink image, a preservation property or the like of the formed image is improved, and a pearl glaze can be imparted to the image. In other words, an image having a pearl glaze can be formed easily and inexpensively. Moreover, the content ratio of the pearl pigment is 0.5 parts by mass or more and 10 parts by mass or less with respect to 100 parts by mass of the thermoplastic resin. With such a content ratio, a pearl glaze can be sufficiently imparted to a formed image, and sufficient permeability for maintaining an image quality can be obtained.

Sixth Embodiment

The thermal-transfer sheet 30 structured as described above can be used in an image forming apparatus such as a printer.

[Image Forming Apparatus]

Figure 6:
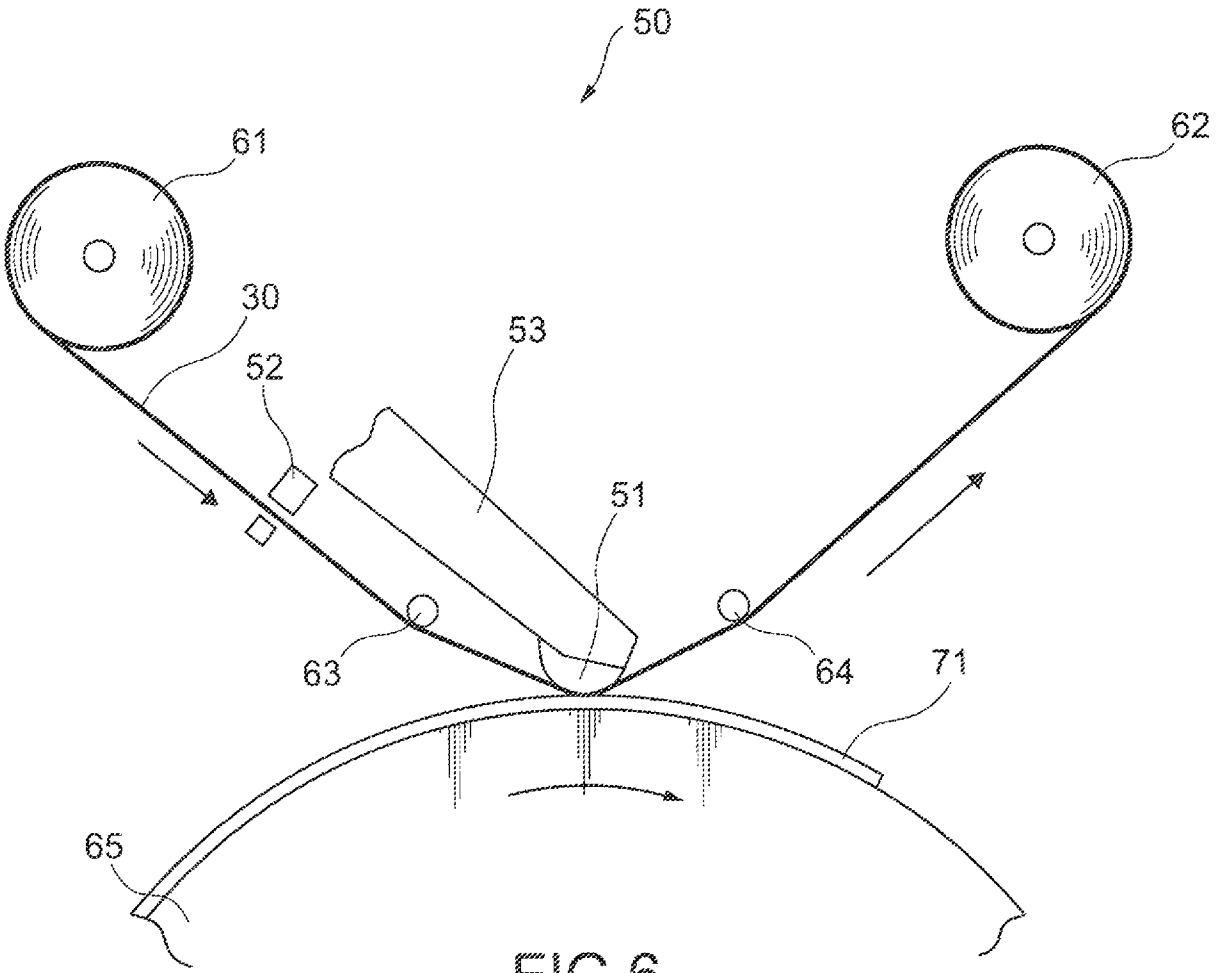
FIG. 6 is a schematic structural diagram showing a main portion of an image forming apparatus according to an embodiment of the present disclosure.

FIG. 6 is a schematic structural diagram showing a main portion of an image forming apparatus 50 according to an embodiment of the present disclosure. The image forming apparatus 50 includes a platen 65 as a conveyor mechanism, the thermal-transfer sheet 30, a feed reel 61 and a take-up reel 62 as a travel mechanism, and a thermal-transfer head 51. The feed reel 61 feeds the thermal-transfer sheet 30, and the take-up reel 62 takes up the thermal-transfer sheet 30. At the same time, guide rollers 63 and 64 guide the thermal-transfer sheet 30 to a print position. The thermal-transfer head 51 is set between the guide rollers 63 and 64. By rotating a to-be-recorded medium 71 (hereinafter, referred to as receiver sheet 71), the platen 65 conveys the receiver sheet 71 to a print position corresponding to the thermal-transfer head 51. Papers that can be printed by thermal transfer, for example, printing papers, are used as the receiver sheet 71.

An example of the main portion in the structure will be described below.

The thermal-transfer sheet 30 wound on the feed reel 61 is taken up by the take-up reel 62 rotationally driven by a drive motor (not shown) while being supported by the guide rollers 63 and 64. A torque limiter (not shown), for example, is provided in the feed reel 61 and applies a back tension to the thermal-transfer sheet 30 by a constant torque. Further, in the take-up reel 62, a take-up detection encoder constituted of an optical sensor (not shown) is provided, for example.

As described above, as dyes corresponding to 1 page, for example, yellow, magenta, and cyan dyes are applied onto the thermal-transfer sheet 30 at a predetermined length. Further, on the thermal-transfer sheet 30, a page head mark and a winding diameter mark are applied at a head position of the dyes corresponding to 1 page, and a color identification mark for identifying a color is applied at a head position of each dye. The marks correspond to the sensor marks 35 described above (see FIG. 5).

As a result, in the image forming apparatus 50, the optical sensor 52 provided in the travel path of the thermal-transfer sheet 30 detects the page head marks and the color identification marks and carries out positioning of head portions of the dyes on the thermal-transfer sheet 30 based on the detection result.

Although not shown, the thermal-transfer head 51 is detachably attached to an end of a pressurization lever 53 rotatably held by a rotary shaft. The other end of the pressurization lever 53 is slidably attached to a comb plate via a link. As a result; the thermal-transfer head 51 is raised and lowered as the comb plate is rotationally driven by a head drive motor and positioned at an intermediate position at which the head can be moved longitudinally, an initial position that is above the intermediate position and is apart from the ribbon, and a bottom position that is below the intermediate position and at which the head comes into contact with the receiver sheet 71. As a result, the thermal-transfer head 51 moves to the initial position when the thermal-transfer sheet 30 is loaded and moves to the bottom position when the receiver sheet 71 is mounted on the platen 65.

The rise and, lowering of the head unit is detected by the optical sensor provided in the vicinity of a notched portion of the comb plate, for example. The thermal-transfer head 51 is structured as an end face type and comes into contact with the receiver sheet 71 via the thermal-transfer sheet 30 across the entire width direction of the receiver sheet 71. As a result, as the receiver sheet 71 is moved in the direction indicated by the arrows, a desired image is printed across the entire surface of the receiver sheet 71.

Using the image forming apparatus 50 having the main portion as described above, a desired image is printed on the receiver sheet 71.

Next, a method of forming an image on a printing paper will be described.

As the thermal-transfer sheet 30 used in the image forming apparatus 50, the thermal-transfer sheet 30 in which the yellow ink layer 31Y, the magenta ink layer 31M, the cyan ink layer 31C, and the image protection layer 13 are repetitively arranged in order from the take-up side (take-up reel 62) to the feed side (feed reel 61) as described with reference to FIG. 5, for example, is used.

By using the image forming apparatus 50, images of yellow, magenta, and cyan color components are subjected to sublimational thermal transfer in the stated order with respect to a receiver layer (printing surface) side provided on the surface of the receiver sheet 71, and then the image protection layer 13 is subjected to sublimation thermal transfer with respect to the entire printing surface. As described above, in the image forming apparatus 50, the lamination process using the image protection layer 13 is carried out by the same process as the image formation of other color information.

In the color print, after an image is printed, the image protection layer 13 is formed on a surface of the image for enhancing a light resistance, a sebum resistance, and the like. Therefore, it is possible to suppress a color degradation of a printed image and enhance a preservation property. Furthermore, since the image protection layer 13 contains a pearl pigment, an image having a pearl glaze can be printed easily and inexpensively. Moreover, since the content ratio of the pearl pigment is 0.5 parts by mass or more and 10 parts by mass or less with respect to 100 parts by mass of the thermoplastic resin, a pearl glaze can be sufficiently imparted to a formed image, and sufficient permeability for maintaining an image quality can be obtained.

Hereinafter, an example of the thermal-transfer laminate film of the present disclosure will be described.

[Production of Thermal-Transfer Laminate Film]

A composition of an untransferring release layer shown in Table 1 was applied onto a base film (polyester, K604E4.5W from Mitsubishi Plastics, Inc.) having a thickness of 4.5 μm such that a dried thickness thereof becomes 1.0 μm and was dried (90° C., 1 min), with the result that an untransferring release layer was formed.

TABLE 1

| | Component name | Composition amount (parts by mass) |
|---|---|---|
| Composition of untransferring release layer | Polyvinyl alcohol (Poval PVA205 from KURARAY CO., LTD.) | 10 |
| | Water | 75 |
| | Isopropanol | 15 |

Subsequently, compositions for forming an image protection layer shown in Tables 2 and 3 were each applied onto the untransferring release layer described above such that a dried thickness thereof becomes 0.8 μm and was dried (90° C., 1 min), with the result that an image protection layer was formed.

TABLE 2

| | Component name | Main grain size (μm) | Composition amount (parts by mass) |
|---|---|---|---|
| Example 1 | Polymethyl methacrylate (MH-101-5 from FUJIKURAKASEI CO., LTD.) | — | 10 |
| | iriodin111 (Merck & Co., Inc.) | <15 | 0.05 |
| | Methylethyl ketone | — | 45.225 |
| | Toluene | — | 45.225 |
| Example 2 | Polymethyl methacrylate (MH-101-5 from FUJIKURAKASEI CO., LTD.) | — | 10 |
| | iriodin111 (Merck & Co., Inc.) | <15 | 0.2 |
| | Methylethyl ketone | — | 45.9 |
| | Toluene | — | 45.9 |

TABLE 2-continued

| | Component name | Main grain size (μm) | Composition amount (parts by mass) |
|---|---|---|---|
| Example 3 | Polymethyl methacrylate (MH-101-5 from FUJIKURAKASEI CO., LTD.) | — | 10 |
| | iriodin111 (Merck & Co., Inc.) | <15 | 1 |
| | Methylethyl ketone | | 49.5 |
| | Toluene | — | 49.5 |
| Example 4 | Polymethyl methacrylate (MH-101-5 from FUJIKURAKASEI CO., LTD.) | — | 10 |
| | iriodin120 (Merck & Co., Inc.) | 5-25 | 0.05 |
| | Methylethyl ketone | — | 45.225 |
| | Toluene | — | 45.225 |
| Example 5 | Polymethyl methacrylate (MH-101-5 from FUJIKURAKASEI CO., LTD.) | — | 10 |
| | iriodin120 (Merck & Co., Inc.) | 5-25 | 0.2 |
| | Methylethyl ketone | — | 45.9 |
| | Toluene | — | 45.9 |
| Example 6 | Polymethyl methacrylate- (MH-101-5 from FUJIKURAKASEI CO., LTD.) | — | 10 |
| | iriodin120 (Merck & Co., Inc.) | 5-25 | 1 |
| | Methylethyl ketone | — | 49.5 |
| | Toluene | — | 49.5 |

TABLE 3

| | Component name | Main grain size (μm) | Composition amount (parts by mass) |
|---|---|---|---|
| Comparative Example 1 | Polymethyl methacrylate (MH-101-5 from FUJIKURAKASEI CO., LTD.) | — | 10 |
| | iriodin111 (Merck & Co., Inc.) | <15 | 1.5 |
| | Methylethyl ketone | — | 51.75 |
| | Toluene | — | 51.75 |
| Comparative Example 2 | Polymethyl methacrylate (MH-101-5 from FUJIKURAKASEI CO., LTD.) | — | 10 |

TABLE 3-continued

| | Component name | Main grain size (μm) | Composition amount (parts by mass) |
|---|---|---|---|
| | iriodin120 (Merck & Co., Inc.) | 5-25 | 1.5 |
| | Methylethyl ketone | — | 51.75 |
| | Toluene | — | 51.75 |
| Comparative Example 3 | Polymethyl methacrylate (MH-101-5 from FUJIKURAKASEI CO., LTD.) | — | 10 |
| | Methylethyl ketone | | 45 |
| | Toluene | — | 45 |

Subsequently, the composition for forming an adhesive layer shown in Table 4 was applied onto the image protection layers of Examples 1 to 6 and Comparative Examples 1 to 3 such that dried thicknesses thereof become 0.8 μm and were dried (100° C., 1 min), with the result that an adhesive layer was formed.

TABLE 4

| | Component name | Composition amount (parts by mass) |
|---|---|---|
| Composition of adhesive layer | Poly-n-butyl methacrylate (MS-2003-1 from FUJIKURAKASEI CO., LTD.) | 10 |
| | Methylethyl ketone | 45 |
| | Toluene | 45 |

Subsequently, a composition for forming a heat resistant slipping layer shown in Table 5 was applied onto the surface of the base film on the other side of the side on which the untransferring release layer, the image protection layer, and the adhesive layer are formed such that a dried thickness thereof becomes 0.4 μm and was dried (100° C., 1 min), with the result that a heat resistant slipping layer was formed.

TABLE 5

| | Component name | Composition amount (parts by mass) |
|---|---|---|
| Composition of heat resistant slipping layer | Polyvinyl butyral (S-LEC BH-3 from Shimizu Chemical Corporation) | 10 |
| | Isocyanate (CORONATE L FROM NIPPON POLYURETHANE INDUSTRY CO., LTD.) | 3 |
| | Phosphate ester (RL-210 from TOHO Chemical Industry Co., LTD.) | 2 |
| | Silicon filler (TOSPEARL from Momentive Performance Materials Inc.) | 0.2 |
| | Methylethyl ketone | 90 |
| | Toluene | 90 |

As described above, the thermal-transfer laminate film 100 described as the first embodiment was produced as Examples 1 to 6, and the thermal-transfer laminate film having the same structure was produced as Comparative Examples 1 to 3.

In addition, for evaluating an addition of an ultraviolet absorber with respect to the image protection layer, thermal-transfer laminate films of Experimental Examples 1 and 2 were produced by the same processes. Compositions for forming the image protection layer in Experimental Examples 1 and 2 are shown in Table 6. It should be noted that the compositions for forming the base film, the untransferring release layer, the adhesive layer, and the heat resistant slipping layer in the examples are the same as those of the examples and comparative examples.

TABLE 6

| | Component name | Main grain size (μm) | Composition amount (parts by mass) |
|---|---|---|---|
| Experimental Example 1 | Polymethyl methacrylate (MH-101-5 from FUJIKURAKASEI CO., LTD.) | — | 10 |
| | Biflair84 (Merck & Co., Inc.) | <25 | 0.2 |
| | Methylethyl ketone | — | 45.9 |
| | Toluene | — | 45.9 |
| Experimental Example 2 | Polymethyl methacrylate (MH-101-5 from FUJIKURAKASEI CO., LTD.) | — | 10 |
| | Biflair84 (Merck & Co., Inc.) | <25 | 0.2 |
| | Tinuvin234 (ultraviolet absorber, BASF Japan Ltd.) | — | 2.04 |
| | Methylethyl ketone | — | 55.08 |
| | Toluene | — | 55.08 |

Hereinafter, evaluations of the examples, comparative examples, and experimental examples will be described.

[Evaluation of Thermal-Transfer Laminate Film]

Using the produced thermal-transfer laminate films, solid white printing was performed on a pure printing paper for "UP-DR150" (2UPC-R154) from Sony Corporation by a "UP-DR150" printer from Sony Corporation, and a pearl glaze evaluation and permeability evaluation of the obtained image were performed visually to thus verify effects of the thermal-transfer laminate films each containing the pearl pigment in the image protection layer.

Regarding a visual evaluation criterion for a pearl glaze, a case where it can be visually recognized that the image surface has a pearl glaze as compared to Comparative Example 3 in which the image protection layer does not contain a pearl pigment was evaluated as o. On the other hand, a case where it can be visually recognized that the image surface does not have a pearl glaze as Comparative Example 3 irrespective of the fact that the image protection layer contains a pearl pigment was evaluated as x.

Meanwhile, also regarding a visual evaluation criterion for permeability, the evaluation was performed using Comparative Example 3 in which the image protection layer does not contain a pearl pigment as the criterion. Specifically, using ways an image obtained by transferring the image protection layer and an image obtained before the image protection layer is transferred in Comparative Example 3 look as the criterion, the ways the images look before and after transfer of the image protection layer were evaluated also in the examples and comparative examples. The case where the image looks the same way as Comparative Example 3 was evaluated as o, whereas the case where the image looks differently was evaluated as x.

Further, the addition of an ultraviolet absorber was also evaluated using the experimental examples. By carrying out an ultraviolet ray irradiation test in Experimental Example 1 in which an ultraviolet absorber is added and Experimental Example 2 in which an ultraviolet absorber is not added, an effect of adding a pearl pigment and an ultraviolet absorber in the image protection layer was verified. This evaluation method was also carried out by a visual evaluation, and a case where there is no change in a pearl glaze in an image before and after ultraviolet ray irradiation was evaluated as o, whereas a case where there is a change Such as a loss of a glaze or a formation of a black spot was evaluated as x.

Table 7 shows results of the visual evaluation on a pearl glaze of an obtained image and the visual evaluation on permeability. It was confirmed that, with the pearl pigment in the image protection layer being 0.5 parts by mass or more with respect to 100 parts by mass of the thermoplastic resin, a pearl glaze is exhibited. On the other hand, although it was confirmed from the evaluation on permeability that permeability equivalent to that of Comparative Example 3 is obtained when the content of the pearl pigment is 0.5 parts by mass or more and 10 parts by mass or less with respect to 100 parts by mass of the thermoplastic resin forming the image protection layer, the permeability is lowered as compared to that of Comparative Example 3 when the content exceeds 10 parts by mass.

TABLE 7

| | Pearl pigment content (pts. mass/100 pts. mass of thermoplastic resin) | Evaluation on pearl glaze | Evaluation on permeability |
|---|---|---|---|
| Example 1 | 0.5 | o | o |
| Example 2 | 2 | o | o |
| Example 3 | 10 | o | o |
| Example 4 | 0.5 | o | o |
| Example 5 | 2 | o | o |
| Example 6 | 10 | o | o |
| Comparative Example 1 | 15 | o | x |
| Comparative Example 2 | 15 | o | x |
| Comparative Example 3 | None | x | o |

Table 8 shows a result of the ultraviolet ray irradiation test on an image that exhibits a pearl glaze. The condition for the ultraviolet ray irradiation test was a continuous irradiation for 60 hours at an illuminance of 60000 lux using a low-temperature cycle xenon weather meter "XL75S" (Suga Test Instruments Co., Ltd.). In Experimental Example 1, it was confirmed that although the pearl pigment contains bismuth oxychloride and the like, by providing an ultraviolet absorber in the image protection layer, a stable resistance is obtained with respect to the ultraviolet ray irradiation test. On the other hand, although the pearl pigment contains bismuth oxychloride and the like also in Experimental Example 2, an ultraviolet absorber is not added. In this case, it was confirmed that bismuth oxychloride is decomposed when the ultraviolet ray irradiation test is carried out, with the result that bismuth is precipitated and a black spot is formed, thus leading town evaluation of x.

TABLE 8

| | Addition of ultraviolet absorber | Evaluation of ultraviolet ray irradiation test |
|---|---|---|
| Experimental Example 1 | Added | o |
| Experimental Example 2 | Not added | x |

From the results above, when the thermal-transfer laminate film includes the image protection layer in which the content ratio of the pearl pigment is 0.5 parts by mass or more and 10 parts by mass or less with respect to 100 parts by mass of the thermoplastic resin, a pearl glaze was confirmed, and sufficient permeability with respect to a printed image was also confirmed. It was also confirmed that, by adding the ultraviolet absorber together with the pearl pigment, a pearl glaze is stably exhibited.

The embodiments of the present disclosure have been described heretofore, but the present disclosure is not limited to the embodiments above and can be variously Modified without departing from the gist of the present disclosure.

It should be noted that the present disclosure can also take the following structure.

(1) A thermal-transfer laminate film, including:

a base film; and an image protection layer that is provided on the base film and contains a thermoplastic resin and a pearl pigment, a content ratio of the pearl pigment with respect to 100 parts by mass of the thermoplastic resin being 0.5 parts by mass or more and 10 parts by mass or less.

(2) The thermal-transfer laminate film according to (1) above, in which a grain size of the pearl pigment is 5 μm or more and 25 μm or less.

(3) The thermal-transfer laminate film according to (1) or (2) above, in which the image protection layer additionally contains an ultraviolet absorber.

(4) The thermal-transfer laminate film according to any one of (1) to (3) above, in which a content ratio of the ultraviolet absorber with respect to 100 parts by mass of the thermoplastic resin is 5 parts by mass or more and 50 parts by mass or less in the image protection layer.

(5) The thermal-transfer laminate film according to any one of (1) to (4) above, further including an untransferring release layer that is formed of a heat resistant resin and provided between the base film and the image protection layer.

(6) The thermal-transfer laminate film according to any one of (1) to (5) above, further including an adhesive layer provided on the image protection layer.

The present disclosure contains subject matter related to that disclosed in Japanese Priority Patent Application JP 2011-047231 filed in the Japan Patent Office on Mar. 4, 2011, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal-transfer laminate film, comprising:

a base film; and a transferable image protection layer that is provided on the base film and contains a thermoplastic resin and a pearl pigment, a content ratio of the pearl pigment with respect to 100 parts by mass of the thermoplastic resin being 0.5 parts by mass or more and 10 parts by mass or less.

2. The thermal-transfer laminate film according to claim 1;

wherein a grain size of the pearl pigment is 5 μm or more and 25 μm or less.

3. The thermal-transfer laminate film according to claim 1;

wherein the image protection layer additionally contains an ultraviolet absorber.

4. The thermal-transfer laminate film according to claim 3;

wherein a content ratio of the ultraviolet absorber with respect to 100 parts by mass of the thermoplastic resin in the image protection layer is 5 parts by mass or more and 50 parts by mass or less.

5. The thermal-transfer laminate film according to claim 1, further comprising:

an untransferring release layer that is formed of a heat resistant resin and provided between the base film and the image protection layer.

6. The thermal-transfer laminate film according to claim 1, further comprising:

an adhesive layer provided on the image protection layer.

7. A thermal-transfer sheet, comprising:

a base film;

a transferable image protection layer that is provided on the base film and contains a thermoplastic resin and a pearl pigment, a content ratio of the pearl pigment with respect to 100 parts by mass of the thermoplastic resin being 0.5 parts by mass or more and 10 parts by mass or less; and an ink layer provided on the base film.

8. An image forming apparatus, comprising:

a conveyor mechanism configured to convey a to-be-recorded medium in a predetermined direction;

a thermal-transfer sheet including:

a transferable image protection layer that is thermally transferred to protect an image and contains a thermoplastic resin and a pearl pigment, a content ratio of the pearl pigment with respect to 100 parts by mass of the thermoplastic resin being 0.5 parts by mass or more and 10 parts by mass or less; and an ink layer that forms an image by being thermally transferred onto a surface of the to-be-recorded medium;

a travel mechanism configured to cause the thermal-transfer sheet to travel; and a thermal-transfer head configured to cause one of the ink layer and the image protection layer of the thermal-transfer sheet to be thermally transferred onto the surface of the to-be-recorded medium.

9. A thermal-transfer laminate film, comprising:

a base film; and an image protection layer that is directly provided on the base film and contains a thermoplastic resin and a pearl pigment, a content ratio of the pearl pigment with respect to 100 parts by mass of the thermoplastic resin being 0.5 parts by mass or more and 10 parts by mass or less.

10. The thermal-transfer laminate film according to claim 9;

wherein a grain size of the pearl pigment is 5 μm or more and 25 μm or less.

11. The thermal-transfer laminate film according to claim 9;

wherein the image protection layer additionally contains an ultraviolet absorber.

12. The thermal-transfer laminate film according to claim 11;

wherein a content ratio of the ultraviolet absorber with respect to 100 parts by mass of the thermoplastic resin in the image protection layer is 5 parts by mass or more and 50 parts by mass or less.

13. The thermal-transfer laminate film according to claim 9, further comprising:

an untransferring release layer that is formed of a heat resistant resin and provided between the base film and the image protection layer.

14. The thermal-transfer laminate film according to claim 9, further comprising:

an adhesive layer provided on the image protection layer.

15. A thermal-transfer sheet, comprising:

a base film;

an image protection layer that is directly provided on the base film and contains a thermoplastic resin and a pearl pigment, a content ratio of the pearl pigment with respect to 100 parts by mass of the thermoplastic resin being 0.5 parts by mass or more and 10 parts by mass or less; and an ink layer provided on the base film.

16. An image forming apparatus, comprising:

a conveyor mechanism configured to convey a to-be-recorded medium in a predetermined direction;

a thermal-transfer sheet including:

a base film;

an image protection layer, directly provided on the base film, that is thermally transferred to protect an image and contains a thermoplastic resin and a pearl pigment, a content ratio of the pearl pigment with respect to 100 parts by mass of the thermoplastic resin being 0.5 parts by mass or more and 10 parts by mass or less; and an ink layer that forms an image by being thermally transferred onto a surface of the to-be-recorded medium;

a travel mechanism configured to cause the thermal-transfer sheet to travel; and a thermal-transfer head configured to cause one of the ink layer and the image protection layer of the thermal-transfer sheet to be thermally transferred onto the surface of the to-be-recorded medium.

* * * * *